United States Patent [19]

Harris

[11] Patent Number: 4,618,104

[45] Date of Patent: Oct. 21, 1986

[54] STRAND TRANSFER

[75] Inventor: Leslie J. Harris, Waterloo, Canada

[73] Assignee: Fiberglas Canada Inc., Toronto, Canada

[21] Appl. No.: 804,393

[22] Filed: Dec. 4, 1985

[30] Foreign Application Priority Data

Jul. 24, 1985 [CA] Canada ..... 487399

[51] Int. Cl.[4] ..... B65H 54/02; B65H 67/04

[52] U.S. Cl. ..... 242/18 G; 242/18 PW

[58] Field of Search ..... 242/18 G, 18 PW, 18 A, 242/18 R; 65/10.1, 11.1

[56] References Cited

U.S. PATENT DOCUMENTS

| | | | |
|---|---|---|---|
| 2,998,202 | 8/1961 | Keith et al. | 242/18 PW |
| 3,767,130 | 10/1973 | Perrino | 242/18 PW |
| 3,838,828 | 10/1974 | Hautemont | 242/18 PW X |
| 3,870,240 | 3/1975 | Miller | 242/18 PW X |
| 4,040,572 | 8/1977 | Melan et al. | 242/18 G X |
| 4,046,329 | 9/1977 | Eisenberg et al. | 242/18 G |
| 4,230,284 | 10/1980 | Cunningham et al. | 242/18 G |
| 4,511,095 | 4/1985 | Ideno et al. | 242/18 G |

*Primary Examiner*—Stanley N. Gilreath

*Attorney, Agent, or Firm*—Dennison, Meserole, Pollack & Scheiner

[57] ABSTRACT

Apparatus for supplying a strand to a winding collet of a strand winding machine has a pair of pull rolls movable between a standby position, in which the pull rolls are spaced from the winding collet to facilitate insertion of the strand between the pull rolls, and a wind-on position, in which the pull rolls guide the strand close to the winding collet to enable automatic initiation of the strand winding.

16 Claims, 18 Drawing Figures

STRAND TRANSFER

FIELD OF THE INVENTION

The present invention relates to strand transfer apparatus for supplying a strand to a winding collet of a strand winding machine.

DESCRIPTION OF THE PRIOR ART

A conventional strand winding machine, for use in winding a strand of filaments of heat-softened mineral material such as glass into a strand package, usually requires the manual intervention of an operator for initiating the winding of the package on a tube on the collet and for doffing the package when the latter has been fully wound.

More particularly, the filaments are produced by an overhead bushing and are passed downwardly across applicators, at which a size is applied to the filaments, and through gathering shoes and alignment combs to a pair of pull rolls. These pull rolls are usually spaced laterally of the winding collet and are rotated so as to pull and attenuate a strand formed from the filaments and, thus, to maintain a desired tension in the strand until it is desired to initiate a winding operation.

At the beginning of the winding operation, the operator firstly fits a collector tube onto the winding collet and then withdraws the strand from the pull rolls, and supplies it to a strand traversing mechanism or beater to initiate the winding of the strand around the winding collet. The winding of the package is then continued by rotation of the winding collet and by deflection of the strand to and fro along the winding collet by a strand traversing mechanism.

Previous attempts have been made to automatically initiate the winding of the strand on the winding collet.

For example, U.S. Pat. No. 4,046,329, issued Sept. 6, 1977 to Arnold J. Eisenberg et al discloses a mechanism for collecting linear material on wound packages in which a rotatably indexible turret or head supports a pair of winding collets, each individually driven by a motor. The head or turret is indexible into two positions in order to move one of the collets, with a completed package thereon, from a winding position and to locate the other winding collet, in an empty condition, in the winding position for the formation of a new package thereon.

Each of the collets comprises a package collection region, where the strand is wound into a package, and a temporary collection region, which comprises an end cap assembly provided with a guide surface or groove extending circumferentially around a free end of the collet and provided with a pin extending into the groove.

On movement of the first one of the winding collets from the winding position, with a wound package thereon, and the consequential movement of the second one of the winding collets into the winding position, the pin on the second winding collet picks-up the strand from the first winding collet and causes the strand to be wound on the temporary collection region of the second winding collet, and to be broken by being pulled in opposite directions between the two winding collets.

It is a particular disadvantage of this prior apparatus that it requires a rotatably indexible turret with two winding collets, and thus necessitates a special, relatively complicated winding collet arrangement, and therefore cannot be applied to an existing, conventional strand winding machine of the type having a single winding collet rotatable about a fixed horizontal axis. Moreover, such double-collet arrangements while capable of automatically changing over from one collet to the other necessitate manual intervention at the beginning of the winding of the first collet and therefore do not allow winding of the strand to be automatically initiated.

In U.S. Pat. No. 4,040,572, issued Aug. 9, 1977 to Giuseppe-Fabrizio Mario Melan et al, there is disclosed a strand winding apparatus which, again, employs an indexibly rotatable turret carrying two winding collets which can be located alternately in a winding position by the rotation of the turret.

In this case, a strand formed from filaments from a bushing is guided, by an operator standing on a floor above the strand winding machine, into position between a pair of pull rolls located at a position below the winding position and serving to attenuate the strand. These pull rolls rotate about fixed axes and are located so that the strand is pulled by the pull rolls against a starting drum mounted on the free end of the collet in the winding position. The starting drum is formed with a groove for receiving the strand and with a pair of diametrically arranged slots in the face of the starting drum, and the strand enters the slots and is thereby gripped and wound on the starting drum. Tension in the strand between the starting drum and the pull rolls causes the strand to break. By rotation of a deflector element, the strand is caused to be engaged by a level line mechanism, which winds the strand on the collet.

Again, this prior strand winding machine is of the automatic type employing a turret for rotating winding collets into and from a winding position and, thus, displacing the winding collets to and from a position in which the winding collets are brought to the strand.

Therefore, this prior strand winding system again has the disadvantage that it cannot be applied to a conventional strand winding machine having a fixed winding collet axis.

Furthermore, as in the case of the apparatus disclosed in the aforesaid U.S. Pat. No. 4,040,572, this prior apparatus has the further disadvantage that the initiation of the winding of the first package must in each case be effected manually.

SUMMARY OF THE INVENTION

It is accordingly an object of the present invention to provide a novel and improved apparatus for automatically initiating the winding of a strand.

It is a further object of the present invention to provide strand transfer apparatus for transferring strand from a standby position spaced from a winding collet to a wind-on position adjacent the winding collet preparatory to winding of the strand.

It is a still further object of the present invention to enable automatic strand winding to be effected on a conventional strand winding machine having a collet rotatable about a fixed axis.

The present invention provides strand transfer apparatus for supplying a strand to a winding collet of a strand winding machine, the strand transfer apparatus comprising a pair of pull rolls for receiving the strand therebetween, first drive means for rotationally driving the pull rolls to advance the strand, movable support means for carrying the pull rolls between a standby position in which the pull rolls are spaced from the winding collet to facilitate insertion of the strand between the pull rolls and a wind-on position in which the pull rolls guide the strand closer to the winding collet, and second drive means for displacing the support means and therewith the pull rolls to and fro between the standby position and the wind-on position.

In operation of this apparatus, the strand may be guided between the pull rolls by an operator standing on a floor above the strand transfer apparatus while the pull rolls are in the standby position, the strand being guided into the standby position by the operator through a hole in the floor. The strand transfer apparatus then enables the strand to be transferred, by displacement of the support means and the pull rolls, from the standby position beneath the hole to the wind-on position, which may be in close proximity to one end of the strand winding collet.

The support means may comprise a tube, the pull rolls being mounted on one end of the tube with a plurality of rollers engaging the tube for supporting and guiding the tube, the second drive means comprising means for rotating one of the rollers.

The present invention further provides apparatus for automatically initiating winding of a strand on a winding collet of a strand winding machine comprises a pair of displaceable pull rolls for receiving the strand therebetween, first drive means for rotationally driving the pull rolls to advance the strand, second drive means for displacing the pull rolls to and fro between a standby position spaced from the winding collet and a wind-on position in the vicinity of the winding collet, and means for withdrawing the strand from between the pull rolls in the wind-on position and winding the withdrawn strand onto the winding collet.

In a preferred embodiment of the invention, the withdrawing means comprise a movable strand deflector means for pressing the strand against the periphery of the winding collet, and the strand deflector means comprises a strand engagement member, means for displacing the strand engagement member to and fro parallel to the axis of rotation of the winding collet past a free end of the winding collet, means for displacing the strand engagement member radially of the winding collet into frictional engagement with the periphery of the latter to clamp the strand against the winding collet, and means for allowing rotation of the strand engagement member about the axis of rotation of the winding collet by the frictional engagement.

BRIEF DESCRIPTION OF THE DRAWINGS

The invention will be more readily understood from the following description of a preferred embodiment thereof given, by way of example, with reference to the accompanying drawings, in which.

Figure 4:
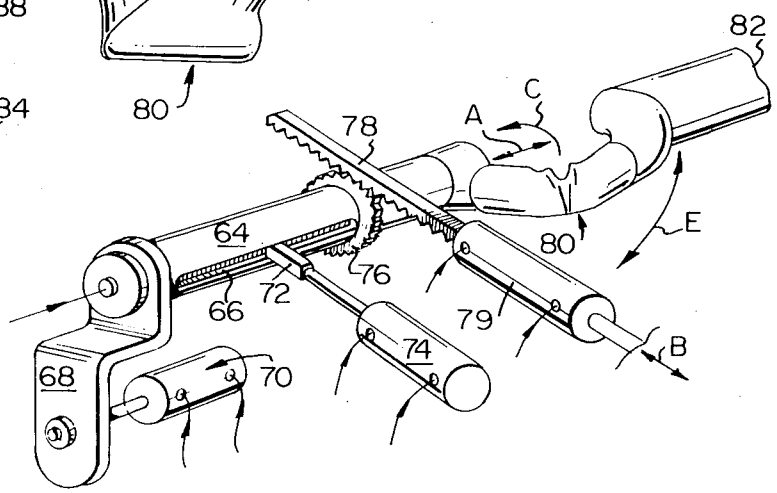
FIG. 4 shows a diagrammatic view in perspective of parts of a strand winding unit for initiating winding of a strand on a winding collet in the strand winding machine of FIG. 1.
Figure 5:
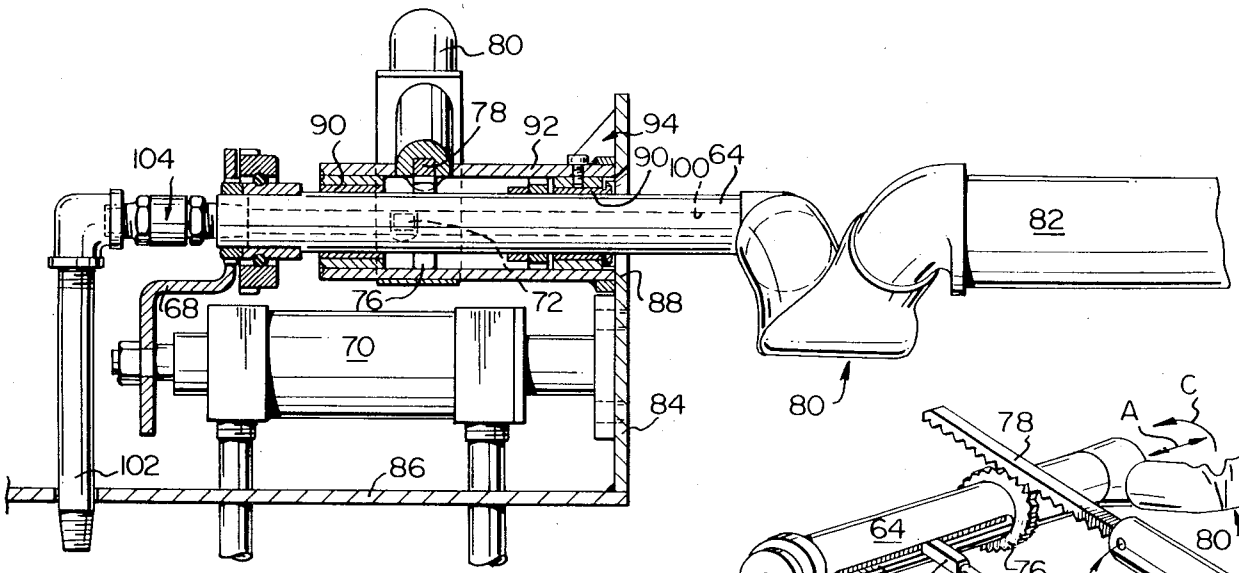
FIG. 5 shows a view taken in vertical cross-section through the strand winding unit of FIG. 4.
Figure 6:
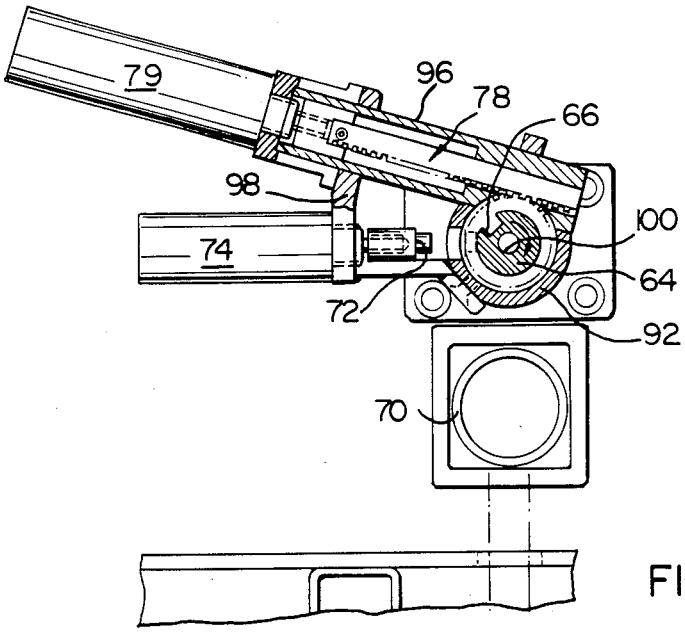
FIG. 6 shows a view taken in transverse section, along the line VI—VI of FIG. 5.

FIG. *7a* shows a view taken in section through a pivot joint forming part of the strand winding unit of FIGS. 4 to 6;

FIG. *7b* shows a view of the pivot joint taken in the direction of arrow F in FIG. *7a;*

FIG. *7c* shows a view taken in cross-section through the pivot joint along the line VII—VII of FIG. *7a;*

Figures 9, 10:
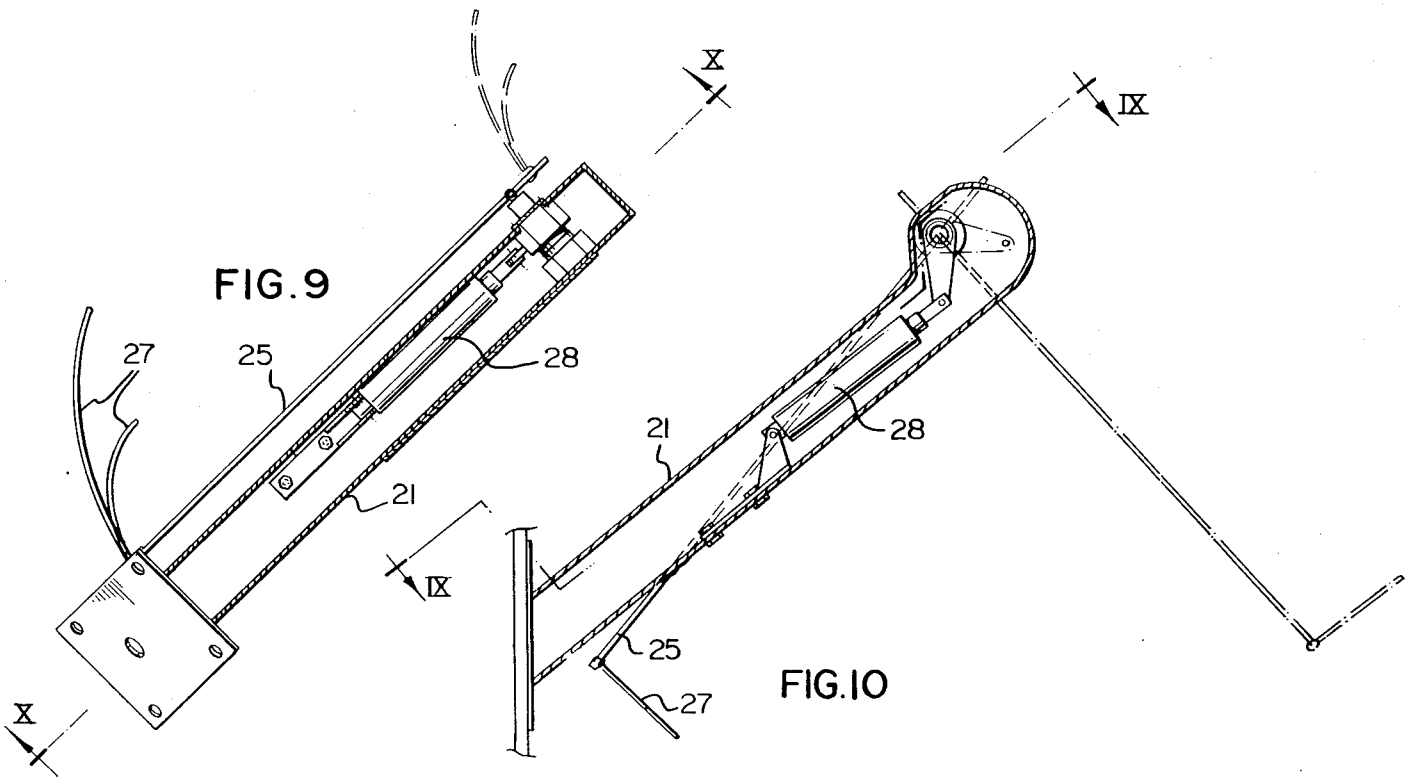

FIGS. *8a* to *8g* show successive steps in the initiation of the winding of a strand on the winding collet by the strand wind-on apparatus of FIGS. 4 to 7;

FIG. 9 shows a view taken in longitudinal cross-section along the line IX—IX of FIG. 10; and FIG. 10 shows a side view, taken in longitudinal cross-section along the line X—X of FIG. 9, of a strand collector support arm.

DESCRIPTION OF THE PREFERRED EMBODIMENT

Figure 1:
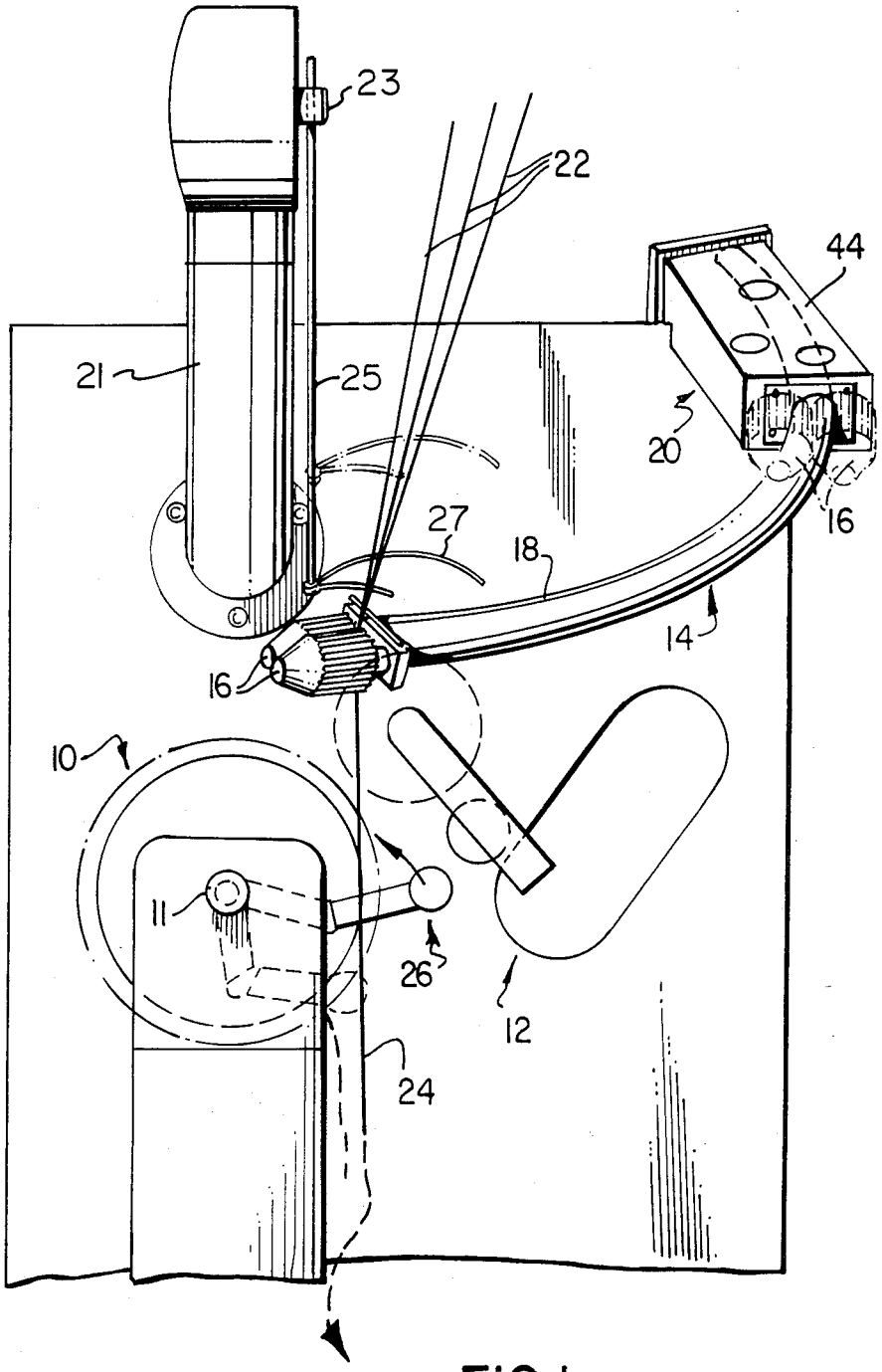
FIG. 1 shows a diagrammatic front view of a strand winding machine.

Referring now to FIG. 1, the strand winding machine illustrated therein has a strand winding collet indicated generally by reference numeral 10, which is rotated about a horizontal axis 11 and which is provided with a strand traverse mechanism indicated generally by reference numeral 12.

The strand winding collet 10, the strand traverse mechanism 12 and the drive means (not shown) for driving these components are of conventional constructions and, therefore, will not be described in greater detail herein.

Above and to one side of the strand winding collet 10 there is provided a strand transfer apparatus indicated generally by reference numeral 14.

The strand transfer apparatus 14 comprises a pair of pull rolls 16 mounted on a free end of a curved tubular support member 18, which can be longitudinally displaced to and fro by a drive unit indicated generally by reference numeral 20, as described in greater detail below.

As in a conventional strand winding machine, the purpose of the pull rolls 16 is to attenuate a strand, formed by filaments 22 passing downwardly from the orifices of a bushing (not shown), so that the strand is kept under a slight tension during intervals between the winding of the strand into strand packages on the strand winding collet 10, the strand material during these intervals being deposited by the pull rolls 16 into an underlying waste strand collection pit (not shown).

In a conventional strand winding machine, the pull rolls are normally located at a stationary position above the level of the strand winding collet and to one side thereof and are rotatable about respective fixed axes of rotation.

In the present case, the pull rolls 16 are displaceable to and fro between a standby position, in which the pull rolls 16 are shown in broken lines adjacent the drive unit 20 in FIG. 1, and a wind-on position, in which the pull rolls 16 are shown in full lines in FIG. 1 and in which they serve to guide the strand, indicated by reference numeral 24, in the vicinity of the free end of the strand winding collet 10.

More particularly, with the pull rolls 20 in the wind-on position, the strand 24 is located in a position in which it can readily be engaged by a strand wind-on mechanism, indicated generally by reference numeral 26, upon actuation of the mechanism 26 for initiating winding of the strand onto the free end of the strand winding collet 10, as will be described in greater detail below.

The strand winding machine shown in FIG. 1 further includes a strand collector 27 which is mounted at the lower, free end of a rod 25, the opposite end of which is supported by a pivot shaft 23 projecting from a support arm 21.

The pivot shaft 23 is pivotable relative to the support arm 21 by a pneumatic cylinder 28 (FIGS. 9 and 10) to move the strand collector 27 into the position in which it is shown in unbroken lines in FIG. 1, for engagement with the filaments 22 when the pull rolls 16 are located in the wind-on position referred to above. The collector 27 is also pivotally retractable by the pneumatic piston and cylinder device 28 into a position shown in broken lines in FIG. 1, in which the collector 27 transfers the strand 24 to the strand traverse mechanism 26 upon withdrawal of the pull rolls 16 from the wind-on position to the standby position.

Figure 2:
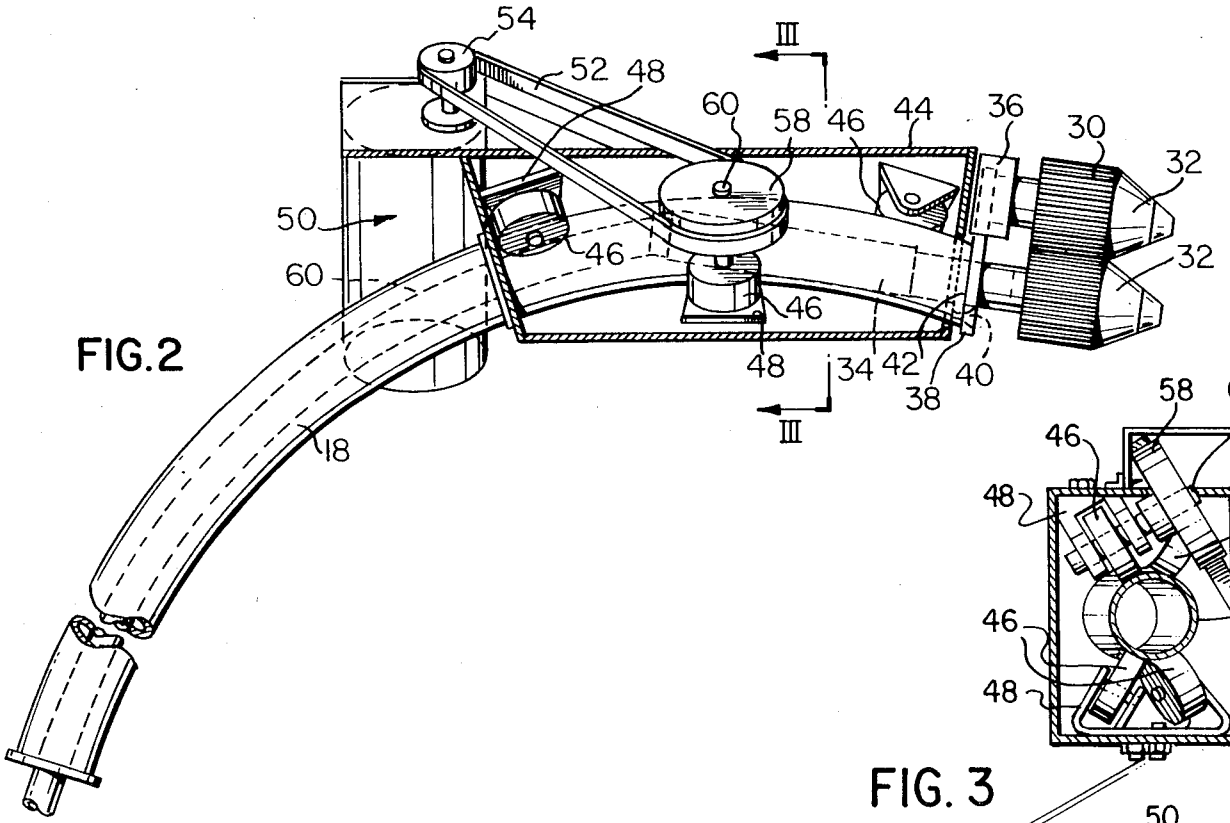
FIG. 2 shows a plan view of a strand transfer apparatus forming part of the machine of FIG. 1.

Referring now to FIG. 2, it will be seen that the pull rolls 16 each comprise a longitudinally toothed portion 30 and a conically tapered end portion 32, the toothed portions 30 meshing with one another for transferring rotational drive from one of the pull rolls to the other.

Within the tubular support member 18 there is provided a pneumatic motor 34 for driving the lowermost one of the pull rolls 16, as viewed in FIG. 2. A spring (not shown) is provided in a spring housing 36 for urging the other pull roll 16 into engagement with the pull roll 16 driven by the pneumatic motor 34. The mounting of a pair of pull rolls so as to be urged together by a spring in a spring housing in this manner is well known in the art and, therefore, will not be described in greater detail herein. For the present purposes, it is sufficient to note that the pull rolls 16 are carried by a plate 38 which is secured by screws (one of which is indicated by reference numeral 40) to a flange 42 welded to the free end of the tubular support member 18. The plate 38 thus serves as a closure across the end of the tubular support member 18 and prevents the entry of contaminates into the tubular support member 18 through this end thereof.

In FIG. 2, the pull rolls 16 are shown in the standby position, and the tubular support member 18 is shown extending through a housing 44 of the drive unit 20.

Figure 3:
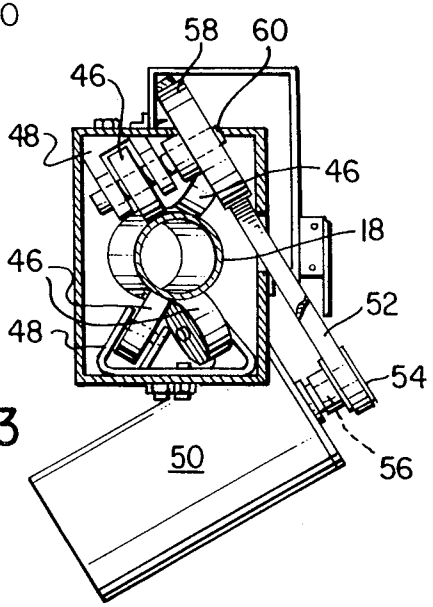
FIG. 3 shows a view of the strand transfer apparatus taken along the line III—III of FIG. 2.

The drive unit 20 comprises four rollers 46, which are distributed around the tubular support member 18 in the manner which will be apparent from FIG. 3 and which are rotatably mounted on brackets 48 secured to the housing 44 for supporting and guiding the tubular support member 18. A drive motor 50 mounted at the exterior of the housing 44 rotatably drives one of the rollers 46 and, thus, longitudinally displaces the tubular support member 18 through the housing 44.

More particularly, the drive motor 50 is connected to a shaft 60 carrying the driven roller 46 by a drive belt 52, a pulley 54 mounted on and secured to a drive shaft 56 of the drive motor 50 and a pulley 58 mounted on and secured to the shaft 60.

An air supply line 60 is connected to the pneumatic motor 34 for operating the latter, the air supply line 60 extending through the end of the tubular support member 18 opposite from the pull rolls 16.

Referring now to FIGS. 4, 5 and 6, the main components of the strand wind-on device will now be described.

It should be understood that, to facilitate comprehension of the wind-on device, a simplified diagrammatic view thereof is shown in FIG. 4 and that FIGS. 5 and 6 more accurately illustrate the structure of this device.

Referring firstly to FIG. 4, the wind-on device has a shaft 64 which is formed with a longitudinal slot 66 and secured at one end thereof to a bracket 68. By actuation of a pneumatic piston and cylinder device 70 connected to the bracket 68, the shaft 64 can be displaced to and fro longitudinally thereof.

A lock pin 72 is slidably engageable in the longitudinal slot 66 to allow the longitudinal displacement of the shaft 64 without allowing rotation of the shaft 64, and can be moved into and out of engagement with the slot 66 by operation of a pneumatic piston and cylinder device 74.

A pinion 76 secured to the shaft 64 meshes with a rack 78, which can be reciprocated by a pneumatic piston and cylinder device 79 for rotating the shaft 64 about its longitudinal axis.

The longitudinal reciprocation of the shaft 64 by the pneumatic piston and cylinder device 70 is indicated by a double-headed arrow A, the reciprocation of the rack 78 by the pneumatic piston and cylinder device 79 is indicated by a double-headed arrow B and the rotation of the shaft 64, which results from the reciprocation of the rack 78 in meashing engagement with the pinion 76, is represented by a double-headed arrow C.

The end of the shaft 64 opposite from the plate 68 carries an elbow mechanism indicated generally by reference numeral 80, which in turn carries a strand engagement finger 82. As described in greater detail hereinafter, the elbow mechanism 80 can be actuated to cause rotation of the finger 82 about an axis parallel to the longitudinal axis of the shaft 64.

The mechanism of the strand wind-on unit of FIG. 4 is illustrated in greater detail in FIGS. 5 and 6, from which it can be seen that the pneumatic piston and cylinder device 70 is connected, at its right-hand end as viewed in FIG. 5, to a wall 84 upstanding from a support plate 86, the wall 84 being formed with an opening 88 through which the shaft 64 extends.

The shaft 64 is supported for longitudinal reciprocation and for rotation in a pair of bushings 90, which are provided within a cylindrical shaft housing 92 secured by welding and by a fillet flange 94 to the wall 84.

The rack 78 is longitudinally slidable within a cylindrical housing 96, which is supported by means of a mounting bracket 98 from the piston and cylinder device 74.

The shaft 64 is formed with a central boring 100, which extends the length of the shaft 64 and communicates, at one end thereof, with an air supply pipe 102, connected to the bore 100 by a quick-acting connector 104.

Figure 7A:
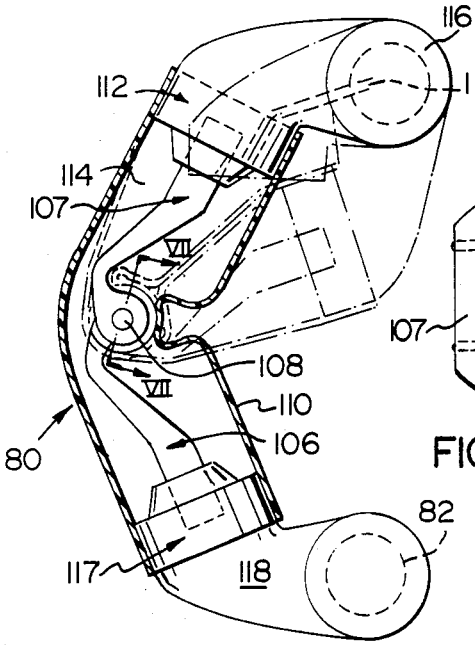
Figure 7C:
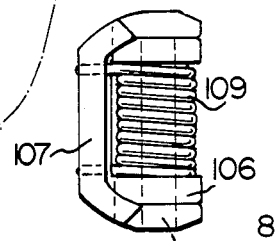
Figure 7B:
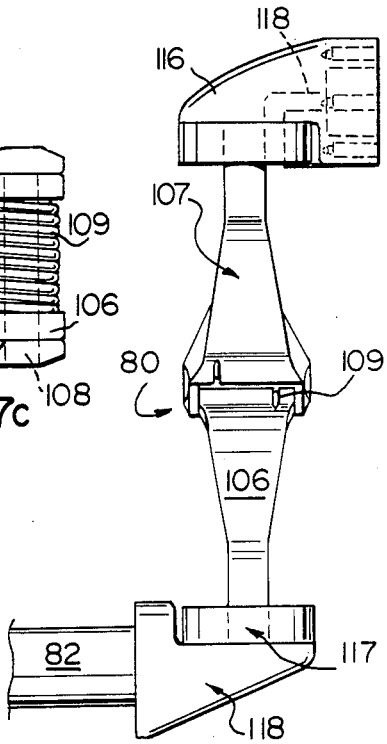

As shown in greater detail in FIGS. 7*a* to 7*c*, the elbow joint indicated generally by reference numeral 80 comprises a pair of arms 106, 107, which are pivotably connected together by means of a pivot pin 108, with a helical spring 109 being provided around the pivot pin 108 for biasing the arms 106 and 107 to pivot towards one another from the relative positions of rotation in which they are shown in FIG. 7*a*.

The arms 106, 107 and the pivot pin 108 are enclosed in a sleeve 110 of resilient material, which is secured at its opposite ends in an air-tight manner to disc-shaped plates 112 on the arms 106 and 107 so as to enclose an air-tight space 104 containing the arms 106, 107 and the pivot pin 108.

The arm 107 is joined, by its disc-shaped plate 112, to a mounting 116, which is secured by screws (not shown) to the end of the shaft 64. An air passage 118 in the arm 107 provides communication between the bore 100 of the shaft 64 and the space 114 of the elbow joint 80.

The finger 82 projects, in a direction perpendicular to the plane of FIG. 7*a*, from a mounting 118 on the disc-shaped plate 117 of the arm 106.

By exhaustion of air from the space 114 through the air passage 118 and the bore 100 of the shaft 64, the air pressure within the space 114 can be reduced sufficiently to enable the spring 109 to effect relative anti-clockwise movement of the arms 106, 107, as viewed in FIG. 7*a*, about the pivot pin 108, so that the arm 106 can be moved into the position in which it is shown in broken lines in FIG. 7*a*.

On the other hand, by supplying compressed air into the space 114 through the air passage 118 and the shaft bore 100, the sleeve 110 can be inflated so as to pivot the arms 106 and 107 relative to one another against the action of the helical spring 109 for spreading the arms into the relative positions in which they are shown in full lines in FIG. 7*a*.

It will be readily apparent that this relative pivotation of the arms 106 and 107 about the pivot pin 108 causes pivotation of the strand engagement finger 82 about the axis of the pivot pin 108, which is parallel to the longitudinal axis of the shaft 64.

The relative pivotation of the arms 106 and 107 about the pivot pin 108 is indicated by a double-headed arrow E in FIG. 4.

The operation of the above-described apparatus will now be described with reference to FIGS. 1, 4 and 8*a* to 8*g*.

At the beginning of the operation of the strand winding machine shown in FIG. 1, and prior to the initiation of the winding of a strand package on the strand winding collet 10, the pull rolls 16 are located in the standby position, in which they are shown in broken lines in FIG. 1.

In this position, the strand 64 can be manipulated, by an operator standing on a floor above the strand winding machine and dangling the strand 24 downwardly through an opening in the floor, so as to locate the strand 24 between the pull rolls 16, the rotation of which then serves to attenuate the filaments 22 as described above.

To initiate the strand winding operation, the drive unit 20 is energized to effect the longitudinal displacement of the tubular support member 18, which is curved along its length in a helical manner and which, therefore, rotates the axes of the pull rolls 16 as the pull rolls 16 are advanced from the standby position to the winding position, in which they are shown in full lines in FIG. 1. Consequently at the wind-on position the axes of the pull rolls 16, as viewed from above, extend approximately at right angles to the longitudinal axis of the winding collet 10.

The strand wind-on device 26 is then operated to initiate the winding cycle of the strand on the winding collet.

More particularly, at the termination of the previous operating cycle the lock pin 72 remains in engagement in the shaft slot 66.

At the beginning of the new cycle, the elbow joint 80 is inflated, so that the finger 82 is held away from the collet.

Figures 8A, 8B, 8C, 8D:
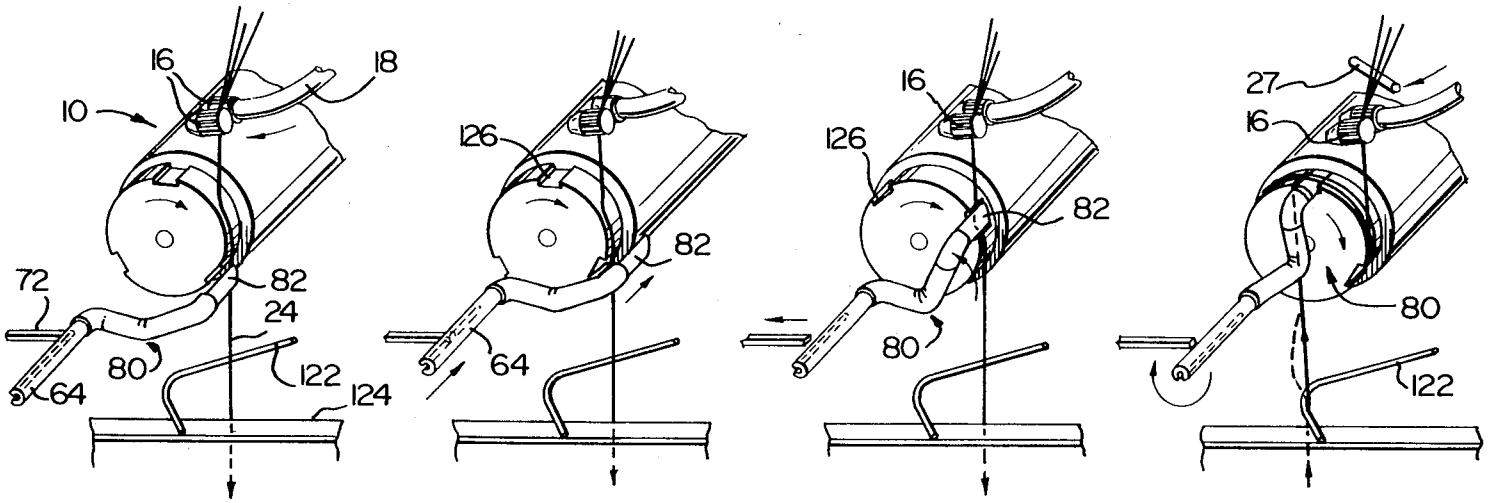
Figure 8G:
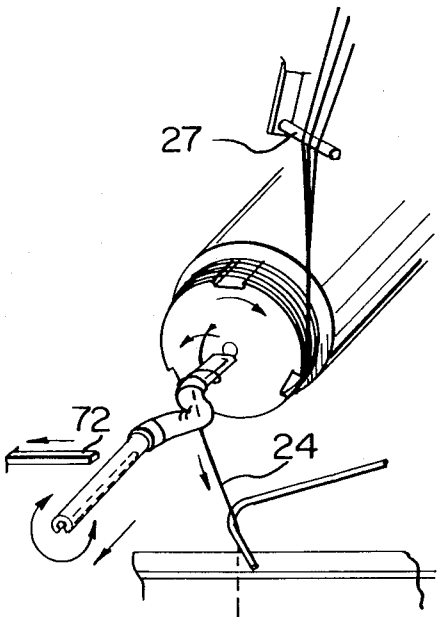

At that time, the pull rolls 16 are advanced into the wind-on position, as described above, so that the strand 24 travels downwardly from the pull rolls 16, as shown in FIG. 8*a* onto the periphery of an end cap 120 on the winding collet, the strand 24 traveling downwardly from the end cap 120 past a guide bar 122, which is supported from a vertical safety plate 124 extending across the front of the strand winding machine. From the guide bar 122, the strand 24 travels downwardly into the strand waste collection pit.

By operation of the piston and cylinder device 70, the shaft 64 is then displaced longitudinally towards the winding collet 10, as shown in FIG. 8*b*, so that the strand engagement finger 82 comes to be located laterally outwardly of the end cap 120, with the strand 24 located between the end cap 120 and the finger 82. The lock pin 72, sliding in the slot 66, prevents rotation of the shaft 64 during this longitudinal movement.

The lock pin 72 is then disengaged from the shaft slot 66 by operation of the piston and cylinder device 74, and simultaneously the air pressure within the elbow joint 70 is reduced so that the latter contracts and, thus, the strand engagement finger 82 is displaced radially inwardly to the end cap 120 by the action of the spring 109 and thereby engages and clamps the strand 24 between the finger 82 and the end cap 120.

The periphery of the end cap 120 is provided with three recesses 126 and, as the end cap 120 rotates, the strand engagement finger becomes located in one of the recesses 126, thus more securely clamping the strand to the end cap 120.

At this time, due to retraction of the lock pin 72 as mentioned above, the shaft 64 is free to rotate and, on engagement of the strand engagement finger 82 in one of the recesses 126, the rotation of the winding collet 10 is imparted to the strand engagement finger 82 which, together with the elbow joint 80 and the shaft 64, are then rotated about the longitudinal axis of the shaft 64, allowing several turns of the strand 24 to become wound around the end cap 120 as shown in FIG. 8*d*.

During the formation of these turns of the strand around the periphery of the end cap 120, the portion of the strand between the end cap 120 and the guide bar 122 also forms a corresponding number of turns around the strand engagement finger 82.

Figure 8F:
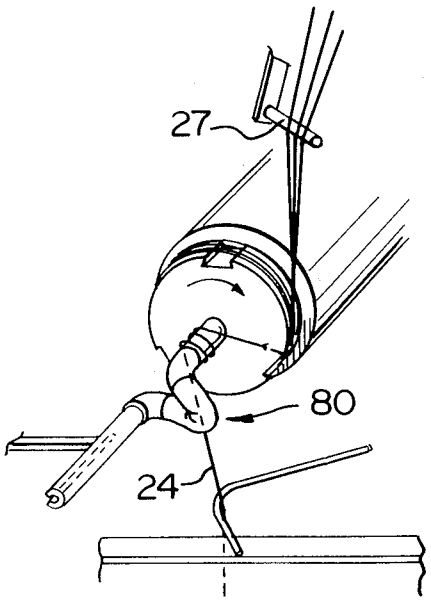
Figure 8E:
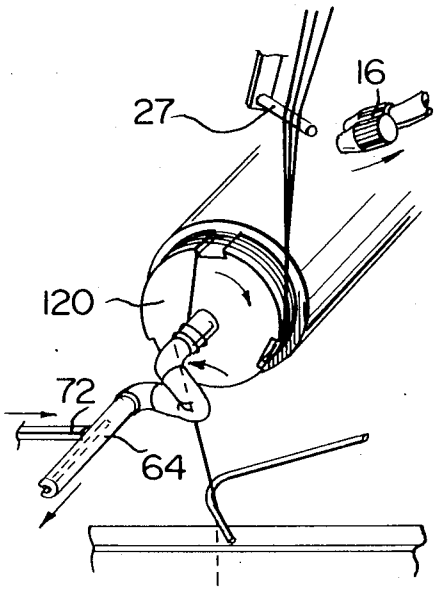

As shown in FIG. 8*e*, the shaft 64 is then displaced longitudinally to withdraw the strand engagement finger 82 from the end cap 120, and the lock pin 72 is advanced to engage once again in the shaft slot 66 and, thus, to restrain the shaft 64 from further rotation. Also, the elbow joint 80 is collapsed, so that the strand engagement finger 82 is brought into substantially axial alignment with the winding collet 10.

In addition, the drive unit 20 is operated to retract the pull rolls 16 from the wind-on position back to the standby position. As the pull rolls 16 are thus withdrawn, the strand is retained by the collector 27 which is pivoted into position behind the filaments as shown in FIG. 8*d*, and thereby withdrawn from between the pull rolls 16. For simplification of the drawings, the collector 27 is shown as a single rod in FIGS. 8*d* to 8*g*.

The winding of the strand 24 around the end cap periphery and around the strand engagement finger 82 causes an increasing frictional engagement between the strand and the strand engagement finger 82, thus increasing the tension in the strand between the strand engagement finger 82 and the end cap 120. Eventually, this tension becomes sufficient to break the strand, as illustrated in FIG. 8*f*.

When this has occurred, the lock pin 72 is again retracted from the shaft slot 66 by operation of the piston and cylinder device 74, and the rack 78 is rapidly reciprocated by the piston and cylinder device 79 to shake the strand engagement finger 82 to and fro about the longitudinal axis of the shaft 64. This shaking of the strand engagement finger 82 causes the remnant of the strand 24 to become released from its frictional engagement with the strand engagement finger 82 and, thus, allows this waste strand material to drop from the strand engagement finger 82 into the waste collection pit.

The collector 27 is then displaced, by actuation of the pneumatic piston and cylinder device 28, to engage the strand 24 with the strand traversing mechanism 12, which winds the strand into a package on a tube (not shown) fitted on the strand winding collet 10 in a conventional manner.

After the completion of the winding of the package, the rotation of the winding collet 10 is slowed down and the drive unit 20 is operated to advance the pull rolls 16 from the standby position to the wind-on position. The collector 27 is displaced to position the strand 24 so that the strand 24 is captured between the pull rolls 16 as the latter approach the wind-on position. Also, the advance of the pull rolls 16 is timed relative to the winding collet speed so that, when the pull rolls 16 capture the strand therebetween, the winding collet is rotating at a speed corresponding to the speed of rotation of the pull rolls.

The collector 27 is then retracted, after which pull rolls 16 are retracted to the standby position, carrying the strand with them and the winding collet is stopped, so that the spare strand is fed by the pull rolls into the waste collection pit.

It should be understood that modifications may be made to the above-described apparatus within the scope of the appended claims.

For example, the strand winding unit may be mounted on rails so as to be movable from one winding collet to another in order to initiate strand winding on a plurality of collets.

The present invention may also be embodied in winding machines of the type having two collets mounted on a rotatable turret.

I claim:

1. Strand transfer apparatus for supplying a strand to a winding collet of a strand winding machine, said strand transfer apparatus comprising:

a pair of pull rolls for receiving the strand therebetween;

first drive means for rotationally driving said pull rolls to advance the strand;

movable support means for carrying said pull rolls between a standby position in which said pull rolls are spaced from said winding collet to facilitate insertion of the strand between said pull rolls and a wind-on position in which said pull rolls guide said strand closer to said winding collet; and second drive means for displacing said support means and therewith said pull rolls to and fro between said standby position and said wind-on position.

2. Apparatus as claimed in claim 1, wherein said support means comprise a tube, said pull rolls being mounted on one end of said tube, and a plurality of rollers engaging said tube for supporting and guiding said tube, said second drive means comprising means for rotating one of said rollers.

3. Apparatus as claimed in claim 2, wherein said first drive means comprise a motor mounted within an end portion of said tube and drivingly connected to one of said pull rolls.

4. Apparatus as claimed in claim 2, wherein said tube is curved along the length thereof about an inclined axis so as to press against said pull rolls.

5. Apparatus for automatically initiating winding of a strand on a winding collet of a strand winding machine, comprising:

displaceable strand attenuating means for pulling the strand;

first drive means for rotationally driving said strand attenuating means to advance the strand;

second drive means for displacing said strand attenuating means to and fro between a standby position spaced from said winding collet and a wind-on position in the vicinity of said winding collet; and means for withdrawing said strand from said strand attenuating means in said wind-on position and winding said withdrawn strand onto said winding collet.

6. Apparatus as claimed in claim 5, including movable strand deflector means for pressing said strand against the periphery of said winding collet.

7. Apparatus as claimed in claim 6, wherein said strand deflector means comprises a strand engagement member, means for displacing said strand engagement member to and fro parallel to the axis of rotation of said winding collet past a free end of said winding collet, means for displacing said strand engagement member radially of said winding collet into engagement with the periphery of the latter to clamp said strand against the winding collet, and means for allowing rotation of said strand engagement member by said winding collet about the axis of rotation of said winding collet.

8. Apparatus as claimed in claim 7, wherein said strand deflector means further comprises means for releasably locking said strand engagement member in a predetermined position of rotation about the axis of rotation of said winding collet.

9. Apparatus as claimed in claim 7, further comprising means for shaking said strand engagement member to and fro about the axis of rotation of said winding collet to remove a strand remnant from said strand engagement member.

10. Apparatus as claimed in claim 7, wherein said means for displacing said strand engagement member radially of said winding collet comprise a pair of arms, means for pivotally connecting together one end of each of said arms, means for resiliently biasing said arms relative to one another about said pivotal connecting means, an inflatable sleeve extending around and connected to said arms and means for supplying compressed air to and from said inflatable sleeve and thereby causing relative pivotal movement of said arms about said pivotal connecting means against the action of said resilient biasing means.

11. Apparatus for initiating winding of a strand on a winding collet of a strand winding machine, said apparatus comprising:

a strand engagement member;

means for moving said strand engagement member across a path of travel of said strand into engagement with said winding collet to thereby clamp said strand to said winding collet; and rotational support means for allowing said strand engagement member to be rotated by said engagement about the axis of rotation of said winding collet to form initial windings of said strand about said winding collet.

12. Apparatus as claimed in claim 11, further comprising means for withdrawing said strand engagement member from said engagement in a direction parallel to the axis of rotation of said winding collet.

13. Apparatus as claimed in claim 11, wherein said rotational support means comprise a shaft in axial alignment with said winding collet, means for rotatably supporting said shaft, means for axially displacing said shaft to and fro relative to said winding collet, a pair of arms connected, respectively, to said shaft and to said strand engagement member for supporting said strand engagement member on said shaft, a pivotal connection means between said arms for allowing relative pivotation of said arms to displace said strand engagement member to and from said winding collet and means for effecting the relative pivotation of said arms.

14. Apparatus as claimed in claim 13, further comprising means for releasably locking said shaft against rotation and thereby retaining said strand engagement member in a predetermined position of rotation prior to engagement of said strand by said strand engagement member.

15. Apparatus as claimed in claim 14, wherein said locking means include means for allowing the axial displacement of said shaft while said shaft is locked against rotation.

16. Apparatus as claimed in claim 13, further comprising means for rotating said shaft to and fro about the axis of said shaft to displace a strand remnant from said shaft.

* * * * *